US009657506B2

(12) United States Patent
Bantle

(10) Patent No.: US 9,657,506 B2
(45) Date of Patent: May 23, 2017

(54) SLIDING ARRANGEMENT

(71) Applicant: Karl Simon GmbH & Co. KG, Aichhalden (DE)

(72) Inventor: Ulrich Bantle, Empfingen (DE)

(73) Assignee: KARL SIMON GMBH & CO. KG (DE)

( * ) Notice: Subject to any disclaimer, the term of this patent is extended or adjusted under 35 U.S.C. 154(b) by 0 days.

(21) Appl. No.: 14/787,091

(22) PCT Filed: Mar. 18, 2014

(86) PCT No.: PCT/EP2014/055383
§ 371 (c)(1),
(2) Date: Oct. 26, 2015

(87) PCT Pub. No.: WO2014/183909
PCT Pub. Date: Nov. 20, 2014

(65) Prior Publication Data

US 2016/0076288 A1 Mar. 17, 2016

(30) Foreign Application Priority Data

May 13, 2013 (DE) ..... 10 2013 104 886

(51) Int. Cl.
*A47B 88/00* (2017.01)
*E05D 13/00* (2006.01)
(Continued)

(52) U.S. Cl.
CPC ..... *E05D 13/1207* (2013.01); *A47B 88/40* (2017.01); *A47B 88/47* (2017.01);
(Continued)

(58) Field of Classification Search
CPC ..... A47B 88/047; A47B 88/0477; A47B 88/0481; A47B 2088/0474;
(Continued)

(56) References Cited

U.S. PATENT DOCUMENTS 203,894 A * 5/1878 Dane ..... G11B 23/023 312/333
2,048,418 A 7/1936 Warren
(Continued)

FOREIGN PATENT DOCUMENTS

DE 19935120 A1 2/2001
DE 10008350 A1 9/2001
(Continued)

OTHER PUBLICATIONS

International Preliminary Report and Written Opinion in corresponding International Application No. PCT/EP2014/055383, dated Nov. 17, 2015, 10 pp. (not prior art).
(Continued)

*Primary Examiner* — Janet M Wilkens
(74) *Attorney, Agent, or Firm* — Lucian Wayne Beavers; Garrett M. Hausman; Patterson Intellectual Property Law, PC

(57) ABSTRACT

A sliding arrangement, in particular a slide-out device for drawers, sliding doors, etc., includes a sliding piece and a pulling arrangement which can be coupled together by a coupling piece. The pulling arrangement can be placed in a resiliently pretensioned manner in a parking position and can be blocked in the parking position by a locking element. In order to ensure a reliable movement of a drawer or the like into the closure position, the locking element may be locked in the parking position of the pulling arrangement by a bar.

12 Claims, 16 Drawing Sheets

(51) Int. Cl.

| | |
|---|---|
| ***E05F 1/16*** | (2006.01) |
| ***E05D 15/36*** | (2006.01) |
| ***A47B 88/40*** | (2017.01) |
| ***A47B 88/47*** | (2017.01) |
| ***A47B 88/483*** | (2017.01) |
| ***A47B 88/57*** | (2017.01) |

(52) U.S. Cl.
CPC ..... *A47B 88/483* (2017.01); *A47B 88/57* (2017.01); *E05D 15/36* (2013.01); *E05F 1/16* (2013.01); *E05Y 2201/22* (2013.01); *E05Y 2201/232* (2013.01); *E05Y 2201/474* (2013.01); *E05Y 2201/488* (2013.01); *E05Y 2800/112* (2013.01); *E05Y 2900/20* (2013.01)

(58) Field of Classification Search
CPC .... A47B 2210/0094; A47B 2210/0056; E05Y 2900/132; E05Y 2201/412; E05Y 2900/20; E05F 1/16; E05F 5/003; E05F 5/027; E05D 13/1207; E05D 15/36
USPC ..... 312/334.7, 330.1, 333, 319.1, 334.6, 312/334.44, 334.46
See application file for complete search history.

(56) References Cited

U.S. PATENT DOCUMENTS

| | | | | |
|---|---|---|---|---|
| 2,421,595 | A | 6/1947 | Brown | |
| 2,666,944 | A | 1/1954 | Stehlin | |
| 3,831,919 | A | 8/1974 | Nicholls | |
| 3,913,901 | A | 10/1975 | Molders | |
| 5,364,179 | A | 11/1994 | Brüstle et al. | |
| 6,736,471 | B2 | 5/2004 | Lin | |
| 6,997,528 | B2 | 2/2006 | Yang | |
| 7,374,260 | B2 | 5/2008 | Lu | |
| 7,533,946 | B2 | 5/2009 | Hoffman | |
| 7,748,800 | B2 | 7/2010 | Compagnucci | |
| 7,854,485 | B2 | 12/2010 | Berger | |
| 7,874,597 | B2 * | 1/2011 | Tomita | A47B 88/0477 292/137 |
| 8,240,787 | B2 | 8/2012 | Chen et al. | |
| 8,671,520 | B2 * | 3/2014 | Tanno | E05F 1/16 16/49 |
| 8,714,671 | B2 * | 5/2014 | Huang | A47B 88/047 312/319.2 |
| 8,905,497 | B2 * | 12/2014 | Bantle | A47B 88/0477 267/150 |
| 2004/0212283 | A1 | 10/2004 | Gasser | |
| 2006/0017358 | A1 * | 1/2006 | Sato | A47B 88/047 312/333 |
| 2007/0132346 | A1 | 6/2007 | Huang | |
| 2012/0124778 | A1 * | 5/2012 | Sato | E05F 5/003 16/94 R |
| 2015/0097473 | A1 * | 4/2015 | Brunnmayr | A47B 88/0481 312/319.1 |

FOREIGN PATENT DOCUMENTS

| | | | |
|---|---|---|---|
| DE | 202004000840 | U1 | 3/2005 |
| DE | 202004019738 | U1 | 3/2005 |
| DE | 102007008688 | A1 | 8/2008 |
| DE | 102011050605 | A1 | 11/2012 |
| EP | 2279680 | A1 | 2/2011 |
| EP | 2713822 | B1 | 7/2015 |
| JP | 2005230468 | A | 9/2005 |
| WO | 2007111424 | A1 | 10/2007 |
| WO | 2008101582 | A2 | 8/2008 |
| WO | 2010112522 | A1 | 10/2010 |

OTHER PUBLICATIONS

English machine-generated translation of previously cited unexamined German Patent Application No. DE 202004000840 U1 published Mar. 10, 2005 to Grass GmbH, Höchst, AT.
English machine-generated translation of previously cited German Patent Application No. DE 102007008688 A1 published Aug. 21, 2008 to Karl Simon GmbH & Co. KG.
English machine-generated translation of previously cited European Patent Application No. EP 2713822 B1 published Jul. 8, 2015 to Karl Simon GmbH & Co. KG.

* cited by examiner

SLIDING ARRANGEMENT

FIELD

The invention relates to a sliding arrangement, in particular a slide-out device for drawers, sliding doors, etcetera, having a sliding piece and a pulling arrangement which can be coupled together by means of a coupling piece, wherein the pulling arrangement can be placed in a resiliently pretensioned manner in a parking position.

BACKGROUND

Such a sliding arrangement is known from DE 10 2011 050 605 A1. In this instance, the sliding arrangements are used in order to enable comfortable operation in particular with handle-free drawers or sliding doors or the like. Accordingly, for example, the closed drawer can be pressed by the user at the front end thereof.

BRIEF SUMMARY

In this instance, a so-called "push-latch mechanism" of the sliding arrangement is triggered and the slide-out arrangement then pushes the drawer into a partially open position. In this partially open position, the drawer can be comfortably gripped by the user and completely pulled out. For a comfortable closing operation, a pull-in device is combined with the slide-out arrangement. This pulls the drawer in the last portion of the adjustment path into the closure position. At the same time, a damper is effective and prevents a harsh stoppage of the drawer in the closure position. The slide-out device uses a spring which, after the push-latch mechanism has been triggered, pushes the sliding piece into the partially open position. The pulling arrangement uses another spring, that is to say, a retraction spring which serves to pull the drawer in the last portion of its adjustment path into the closure position. Consequently, two springs are therefore used which introduce opposing resilient forces into the drawer. The slide-out spring is therefore preferably sized with a smaller spring constant than the retraction spring. During the closure operation of the drawer, the kinetic energy of the drawer is used in order to tension the pull-out spring in order to simulate the most "natural closure operation" possible without the drawer additionally having to be pushed by a user in the last portion of the closure path in order to tension the slide-out spring. Since the slide-out spring is tensioned, a switching operation has to take place, which then releases the pulling arrangement in order to place the drawer in the closure position. The kinetic energy of the drawer is also preferably used for the activation of the switching arrangement. When the drawer is now pushed closed very slowly, although the kinetic energy may be sufficient to tension the pushing-out arrangement, the switching arrangement is then no longer triggered so that a pulling-in action into the closure position is not brought about.

An object of the invention is to provide a sliding arrangement of the type mentioned in the introduction which makes optimum use of the kinetic energy of the drawer in the closure path thereof.

This object is achieved in that the locking element which blocks the pulling arrangement in the parking position is locked by means of a bar. In order to move the locking element into the release position, the bar has to be moved. The parking position may be structurally configured in such a manner that only little energy is required in order to move the locking element from the parking position. The actuation of the bar may be carried out with little application of force so that, for the switching operation, only a very small portion of the kinetic energy has to be used. Consequently, a very slowly running drawer is also pulled into the closure position without problems.

In a particularly preferred manner, there is provision for the bar to be able to be actuated counter to the pretensioning of a spring. The spring may in this instance be provided with a small spring constant in order to enable a low-force actuation of the bar. A simple construction is produced when there is provision for the bar to have a switching piece which cooperates with a release portion in order to move the bar from the locking position (or locked position). Consequently, when the locking element is moved into the parking position, the bar is actuated by the locking element itself so that no additional component and assembly complexity is required.

A sliding arrangement according to the invention may be configured in such a manner that the locking element has a retention member which carries a guiding element and that the guiding element is adjusted in a guide when the locking element is displaced with the pulling arrangement.

A reliable condition of the locking element is possible in that it has a switching attachment which can be actuated indirectly or directly by the sliding piece. Consequently, the locking element can be clearly controlled on the switching attachment thereof by the sliding piece.

If there is provision for the locking element to be pivotably supported on a bearing of the pulling arrangement, and for the locking element to form the retention member and/or the switching attachment as a lever arm, then a simple construction is brought about and, on the other hand, by means of the adjustment of the lever arms, the required forces for operating the locking element can be kept low.

A particularly preferred variant of the invention involves the bar having an actuation piece which is acted on by means of a switch in order to actuate the bar when the locking element is blocked. The switch accordingly serves to move the bar out of its closure position and to release the locking element. Consequently, the switch can be sized in such a manner that it can be operated with little application of force in order to release the bar.

In this instance, there may preferably be provision for the switch to be pivotably supported on a bearing of the pulling arrangement in order to form a uniform subassembly. In addition, a high level of switching precision is thereby achieved, in particular when the locking element is also retained on the pulling arrangement.

A simple actuation of the switch may be achieved in that it can be switched indirectly or directly by means of the sliding piece.

The switch may be constructed again as a lever, which can be moved into operational connection by means of a first lever arm with the sliding piece and a second lever arm with the bar. By means of the lever arms, the force relationships can be translated in an optimum manner.

In order to make sliding arrangements usable with modern drawer systems, they must not exceed a specific structural size. In particular, the sliding arrangements must be flat and must not have an excessive longitudinal extent in the direction of the sliding movement of the drawers.

In order to now provide a small sliding arrangement, which also has a minimized extent in the pushing direction of the drawer, there may be provision for the sliding piece to be connected, at the end region thereof facing the retraction position (a release end), indirectly or directly to a release piece, wherein the release piece can be moved between a release position and a locking position, and for the sliding piece to be connected, at the region thereof facing away from the retraction position (a coupler end), to the coupling piece (or coupler). By means of this construction of the sliding piece, a construction is possible in which the components of a sliding arrangement fitting may be arranged one above the other in order to achieve a small longitudinal extent in the pushing direction.

It is also conceivable to provide a sliding arrangement which brings about a long slide-out path over the sliding piece. To this end, there may be provision for two springs to act on the sliding piece in order to move it into the slide-out position. In this instance, the springs preferably do not act together at least over a part-region of the displacement path but instead a stepped relaxation of the springs is brought about at least in part-regions. When the two springs which are responsible for the sliding-out movement are tensioned, these can consequently be tensioned one after the other, at least partially, which enables an optimum use of the kinetic energy of the drawer.

Preferably, both springs act at least in a part-region of the slide-out path in a parallel manner on the sliding piece. Preferably, they act at the beginning of the slide-out path in a parallel manner in order to be able to introduce a strong slide-out impulse into the drawer. A possible configuration of the invention involves one spring acting as a pressure spring and the second spring acting as a draw spring on the sliding piece in order to be able to achieve a spatially optimized configuration of the sliding arrangement.

The invention is explained in greater detail below with reference to an embodiment illustrated in the drawings. FIGS. 1 to 31 show different functional positions of a sliding arrangement according to the invention.

DETAILED DESCRIPTION

Figure 1:
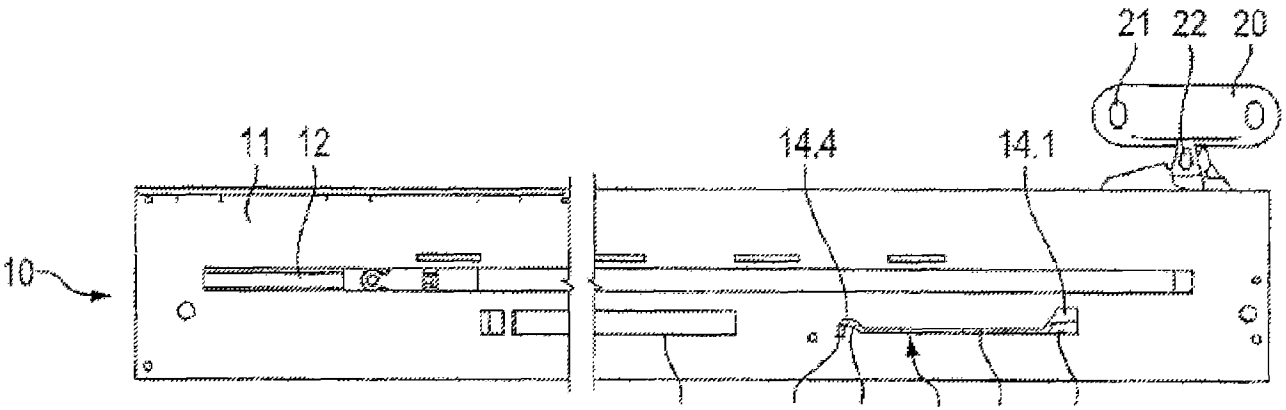
FIG. 1 shows a side view of an embodiment of the sliding arrangement in the basic, or retraction, position.
Figure 2:
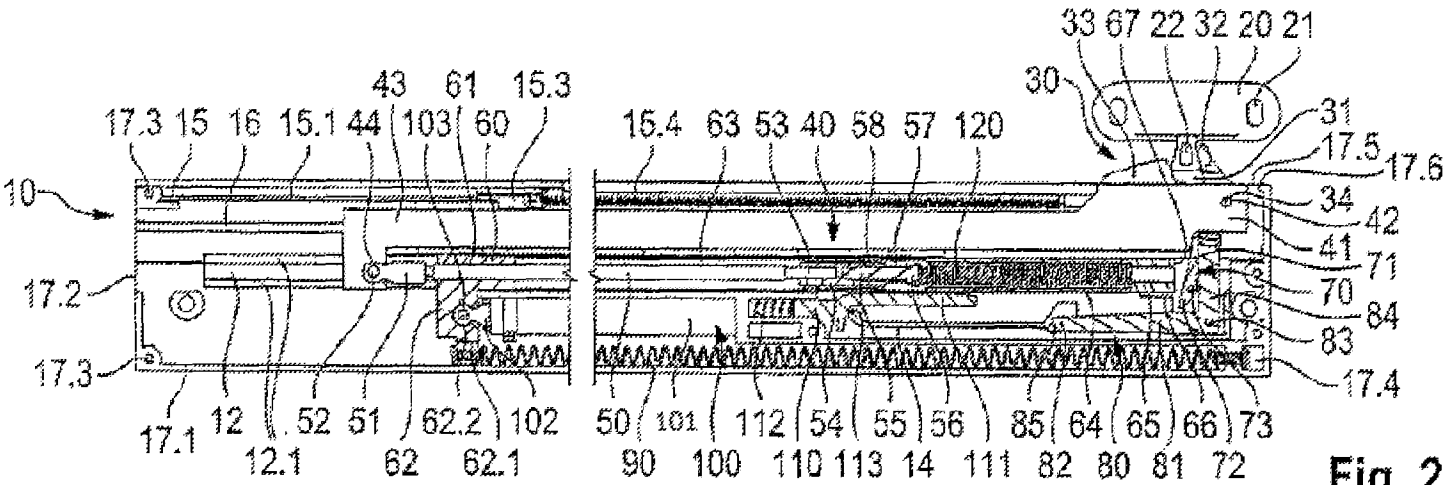
FIG. 2 shows a cross-sectional view of the sliding arrangement of FIG. 1 behind one of the covers.

As FIGS. 1 and 2 show, the sliding arrangement (or slide-out assembly) has a housing 10 which has a vertical wall 11, from which side walls 17.1 rise peripherally. In the region of the corners of the housing 10, screw receiving members 17.3 are provided. A cover can be placed on the side walls 17.1 and this can be screwed to the screw receiving members 17.3. In order to make the inner workings of the sliding arrangement identifiable, the cover is removed in the Figures and the inner structure of the sliding arrangement is illustrated partially in section. The housing is provided centrally with a guide 12 which has two support portions 12.1 which are spaced apart from each other. Furthermore, the housing 10 has a damper receiving member 13 and another guide 14. The guide 14 is recessed from the wall 11. The guide may also be referred to as a guide recess 14. It has an expansion 14.1 which merges into a linear guiding portion 14.2. The guiding portion 14.2 terminates in the region of a ramp portion 14.3. The ramp portion 14.3 merges via a gate location 14.4 into a blocking portion 14.5.

Figure 11:
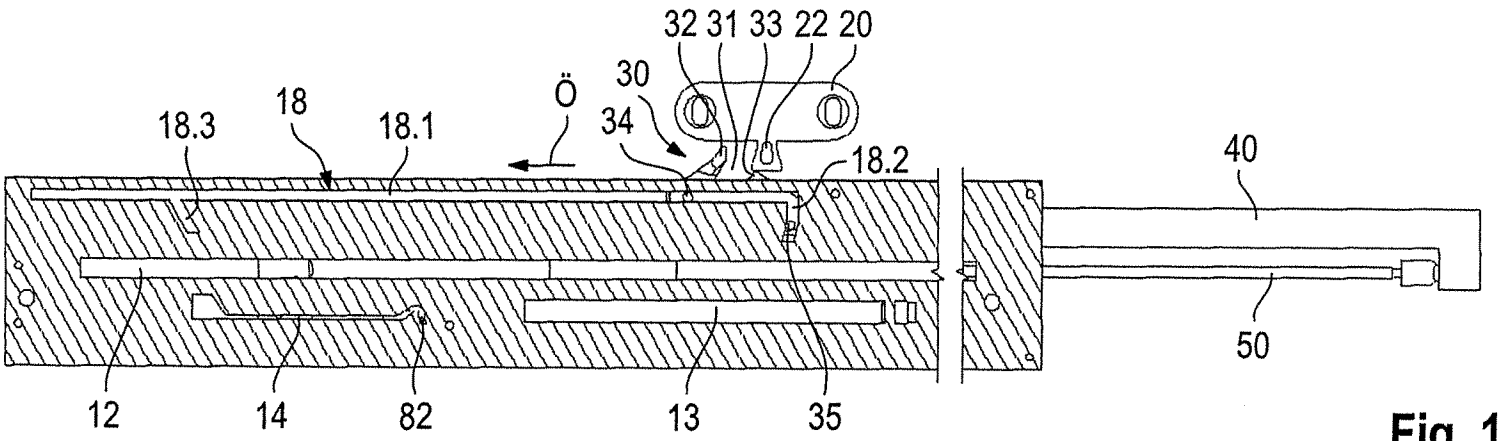
FIG. 11 shows a cross-sectional view of the sliding arrangement of FIG. 1 through the wall of the housing as the release piece begins to move to the tilted-away position in FIGS. 9 and 10.
Figure 27:
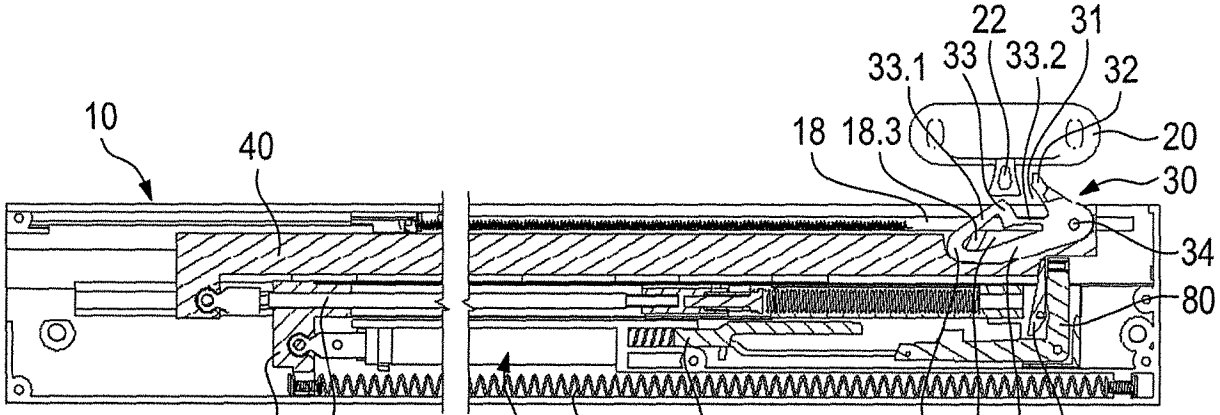
FIG. 27 shows a cross-sectional view of the sliding arrangement of FIG. 26 through the sliding piece.

As can be seen in FIG. 2, in the upper region of the housing there is provided a stop 15 which adjoins a guide 15.1. In this guide, a guiding piece 15.3 extends and can be adjusted in a linear and guided manner in the guide 15.1. In this instance, the adjustment can be carried out to the left from the basic position shown in FIG. 2 after the guiding piece 15.3 comes to rest on the stop 15. Below the guide 15.1, a third guide 16 is formed. The guide 16 is constructed in the form of web-like projections which are formed integrally on the wall 11. In this instance, these webs again form a linear guide 16. It can further be seen in FIG. 2 that the side 17.1 is provided with an opening 17.2 in the region of the left-hand vertical narrow side of the housing 10 in order to enable access to the inner space of the housing. Opposite, at the right-hand housing end, a resilient retention member 17.4 is formed integrally in the region of the side walls 17.1 which are adjacent at right angles. In the upper longitudinal region of the housing 10, a slot 17.5 is recessed from the upper side wall 17.1. The slot 17.5 is delimited by cover portions 17.6 of the side wall 17.1. In the region of the slot 17.5 there is provided a guiding path 18 whose construction can be seen in greater detail in FIG. 11. FIG. 11 is a vertical section through the wall 11 of the housing 10. As can be seen in this illustration, the guiding path 18 is introduced into the side wall 11 in the form of a recess. It has a linear guiding portion 18.1 which in the region of the two left-side ends opens into a parking portion 18.2, 18.3 in each case. It can further be seen in FIG. 11 that a release piece 30 can be adjusted in the guiding path 18. The release piece 30 has a carrier receiving member 31 which is delimited by two stops 32, 33. The release piece 30 is provided with two guiding elements 34, 35 which are constructed as attachments and which are guided in the guiding path 18. In this instance, the guiding element 34 forms a longitudinal guide and in addition a pivot axis about which the release piece 30 can be pivoted. FIG. 11 shows the release piece 30 in the pivoted-away release position. FIG. 1 shows the release piece 30 in the tilted blocking position thereof in which the two guiding elements 34, 35 can be adjusted in the linear region of the guiding portion 18.1. The detailed construction of the release piece 30 can be seen in FIG. 27. As shown in this illustration, the stop 32 is secured to a base portion of the release piece 30, wherein this base portion receives the guiding element 34. The second stop 33 is formed integrally on a resilient portion 33.1. The resilient portion 33.1 merges via a connection 33.2 into the base portion, wherein the connection 33.2 integrally connects the stop 33 to the base portion. Counter to the stop 33, the resilient portion merges into an articulated region 36. The articulated region 36 is formed on an extension arm 37 which again merges integrally into the base portion. The release piece 30 is pivotably coupled to a sliding piece 40. The sliding piece may also be referred to as a slide piece 40. In this instance, the pivotable coupling is advantageously carried out by means of the guiding element 34. In this manner, the release piece 30 can be pivoted between the blocking position illustrated in FIG. 2 and the release position shown in FIG. 11. To this end, the sliding piece 40 has an attachment 41 which receives the release piece 30 in a receiving member which is provided therefor. This receiving member may form stops which support the release piece 30 in the folded-away position thereof (see FIG. 27).

As further shown in FIG. 2, an activator cooperates with the release piece 30. The activator has securing receiving members 21 on a securing plate. A carrier 22 is integrally formed on the securing plate. The carrier 22 can be received in the carrier receiving member 31 of the release piece 30. Generally, the activator 20 is mounted at the body side, whilst the housing 10 is mounted with the sliding arrangement of the drawer which is intended to be operated. Of course, however, a transposed association can also be selected.

The sliding piece merges from the attachment 41 with the bearing 42 for the guiding element 34 of the release piece 30 into a connection portion which terminates as a retention member 43. The retention member 43 has a receiving member 44. FIG. 2 shows the retraction position of the drawer. The release piece is thus in the retraction position. As can be seen in FIG. 2, the sliding piece 40 is constructed in such a manner that the retention member 43 facing away from the retraction position has the receiving member 44. The sliding piece 40 is constructed in such a manner that it can be adjusted in a linear manner in the guide 16 by means of attachments. In this instance, the adjustment movement is carried out in the drawing plane according to FIG. 2.

In the region of the retention member 43, a coupling piece 50 is associated with the sliding piece 40. The coupling piece may also be referred to as a coupler 50. The coupling piece 50 has a coupling head 51 with a connector 52 which is received in the receiving member 44 of the retention member 43 and is secured at that location. The coupling piece 50 is screwed with an adjustment thread onto a threaded attachment of a transfer piece. The transfer piece has a thread 53 at the end thereof facing away from the connector 52. This thread is screwed into a retention member 54 of a switching arrangement. The retention member carries a carrier 55 opposite the thread 53. The carrier 55 is provided with a support member 56. Between the support member 56 and the delimitation edge of the retention member 55, there is formed a bearing receiving member 57 for a catch ring 58 which can be twisted on the carrier 55. Using the delimitation edge and the support member 56, the catch ring 58 is retained in an axially non-releasable manner. The catch ring 58 has on the outer contour thereof a switching attachment which is guided in a control cam of a pulling arrangement 60. The pulling arrangement may also be referred to as a pull assembly 60. The catch ring and the control cam form in the form of a ball-point pen mechanism a releasable coupling connection between the pulling arrangement and the switching arrangement, and consequently finally therefore a releasable connection between the sliding piece 40 and the pulling arrangement 60. In the pulling arrangement 60, a spring 120 is retained in a spring receiving member. The spring 120 acts as an ejection spring and is retained in FIG. 2 in the pretensioning position thereof, wherein the spring 120 is supported on the one hand at the right-hand end on the housing of the pulling arrangement 60 and, on the other hand, on the support member 56.

The pulling arrangement 60 has a bearing 61 in which the transfer piece of the coupling piece 50 is guided in a linear manner, as can be seen clearly in FIG. 2. In the region of the bearing 61, the pulling arrangement 60 is a retention member 62. The retention member 62 is provided with a spring receiving member 62.1 and a damper receiving member 62.2. The pulling arrangement 60 is a covering portion 63 which is constructed in a cylindrical manner at the outer contour thereof. It is supported on the circle-segment-like support portions 12.1 of the guide 12 in such a manner that the outer contour of the covering portion 63 terminates in a planar manner with the outer contour of the wall 11 or at least substantially terminates with the outer contour of the wall 11 in order to be able to bring about a small structural width. An identical guide of the covering portion 63 may also be provided at the opposite side on the cover. As already explained above, the pulling arrangement has a spring receiving member 64 which is constructed in the manner of a housing, and receives the spring 120 in a manner which prevents it from buckling.

In the region of the spring receiving member 64, the pulling arrangement 60 has a stop portion 65. An end stop 67 is formed on the stop portion 65. A securing portion 66 is further formed on the stop 65. As already mentioned above, the pulling arrangement 60 can be adjusted in a linear manner in the guide 12 and in the leaf plane according to FIG. 2. A switch 70 and a locking element 80 are pivotably secured to the securing portion 66. The locking element may also be referred to as a lock element 80. The switch 70 is constructed as a dual lever and has two lever arms 71, 72. The switch may also be referred to as an actuation switch 70, and the two lever arms may also be referred to as a first switch lever arm 71 and a second switch lever arm 72. It is secured to the securing portion 66 so as to be able to be pivoted about a bearing 73. The bearing may also be referred to as an actuation switch bearing 73.

The locking element 80 is constructed as a dual lever. It has as a first lever arm a switching attachment 84 and as a second lever arm a retention member 81. The switching attachment may also be referred to as a lock switch member 84. The locking element 80 is secured to the securing portion 66 so as to be able to be pivoted about a bearing 83. The bearing may also be referred to as a lock bearing 83. The pivoting movement of the locking element 80 and the switch 70 extends in the drawing plane according to FIG. 2.

The retention member 81 carries in the form of a projection a guiding element 82 which engages in the guide 14. At the link-side end, the retention member 81 has a release member 85, for example, in the form of a shaped inclination. The release member may also be referred to as a lock release portion 85.

As can further be seen in FIG. 2, a damper 100 is coupled to the pulling arrangement 60. The damper 100 has a damper housing 101 and a piston rod 102 which can be adjusted therein. In the present embodiment, the damper 100 is constructed as a linear air damper. It may also be constructed as a linear fluid, in particular a linear oil damper. The damper housing 101 is accommodated in the damper receiving member 13. In this instance, for the purposes of a narrow structural width, the cylindrical damper housing is adjusted in the guide 14 in such a manner that it terminates with the outer contour thereof with the outer side of the wall 11 or substantially with the outer side of the wall 11. The piston rod 102 is secured by means of a coupling piece 103 to the damper receiving member 62.2 of the pulling arrangement 60. Below the damper 100 a spring, in this instance a helical spring, is arranged as a draw spring. The spring 90 is secured at the one long-side end thereof to the spring retention member 17.4 of the housing 10, the other end of the spring 90 is secured to the spring receiving member 62.1 of the pulling arrangement 60.

Between the spring 90 and the sliding piece 40, a bar 110 is arranged. The bar 110 is fixedly secured to the housing 10. The bar 110 has an actuation piece on which a switching piece 113 is integrally formed. The switching piece may also be referred to as a bar switch portion 113. The switching piece 113 may be constructed in the form of a shaped inclination. The bar 110 can be adjusted counter to the pretensioning of a spring 112 with a low spring constant in the housing 10 in a linear manner in the plane of the drawing according to FIG. 2. The spring may also be referred to as a bar spring 112.

The procedure for operating the slide-out arrangement which is illustrated in the drawings is described below.

Figure 3:
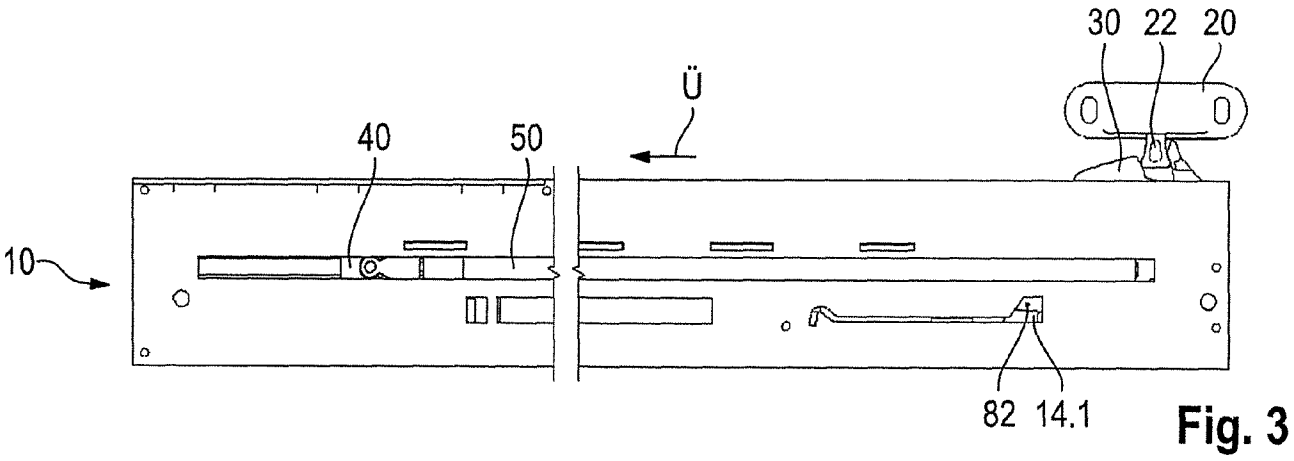
FIG. 3 shows a side view of the sliding arrangement of FIG. 1 as an excess travel is applied to the drawer front of the drawer.
Figure 4:
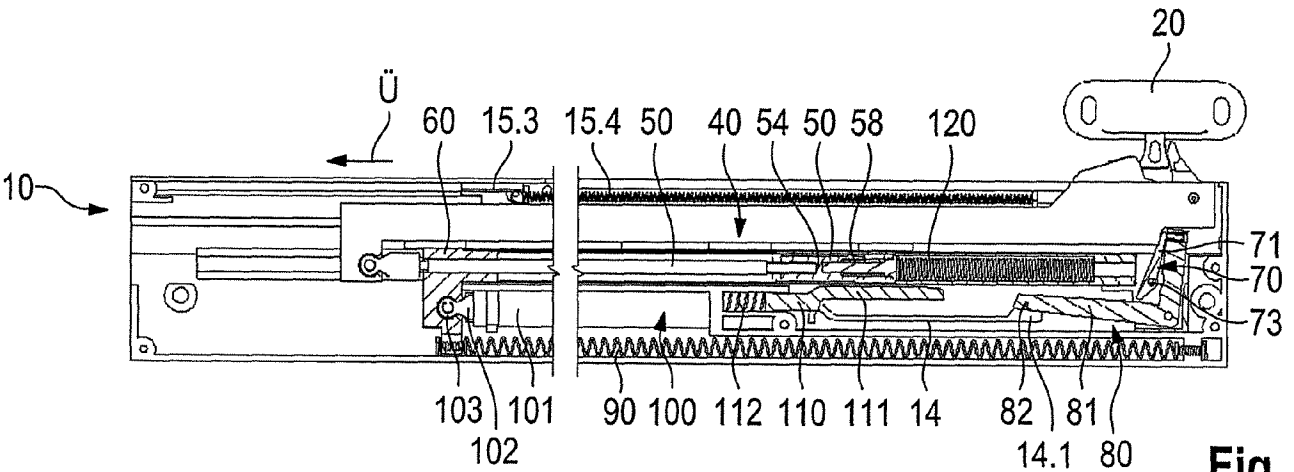
FIG. 4 shows a cross-sectional view of the sliding arrangement of FIG. 3 behind one of the covers.

FIG. 1 shows, as already mentioned above, the retraction position, therefore the position in which the drawer is located in the retracted and secured position thereof. Starting from this position, an excess travel Ü, as indicated in FIG. 3, is applied to the drawer front of the drawer. As a result of this excess travel Ü, the housing 10 of the sliding arrangement is moved to the left in the plane of the drawing according to FIGS. 3 and 4. FIG. 4 illustrates how the component associations change in the event of excess travel Ü. Since the sliding piece 40 is fixedly blocked on the activator 20, the housing 10 moves to the left with respect to the sliding piece 40. The pulling arrangement 60 is also moved to the left with the housing 10. The switching arrangement thereby moves with excess travel with the retention member 54 thereof. This means that the catch ring 58 is twisted with the catch attachment thereof in the slotted switching member of the pulling arrangement 60. The excess travel adjustment is carried out counter to the pretensioning of the spring 120.

Figure 5:
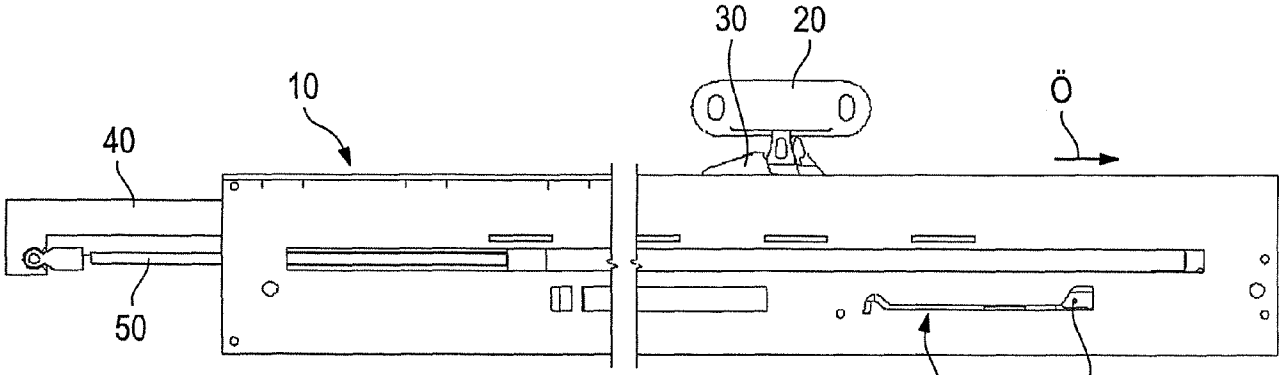
FIG. 5 shows a side view of the sliding arrangement of FIG. 1 as it begins to move in the opening direction due to at least one spring.
Figure 6:
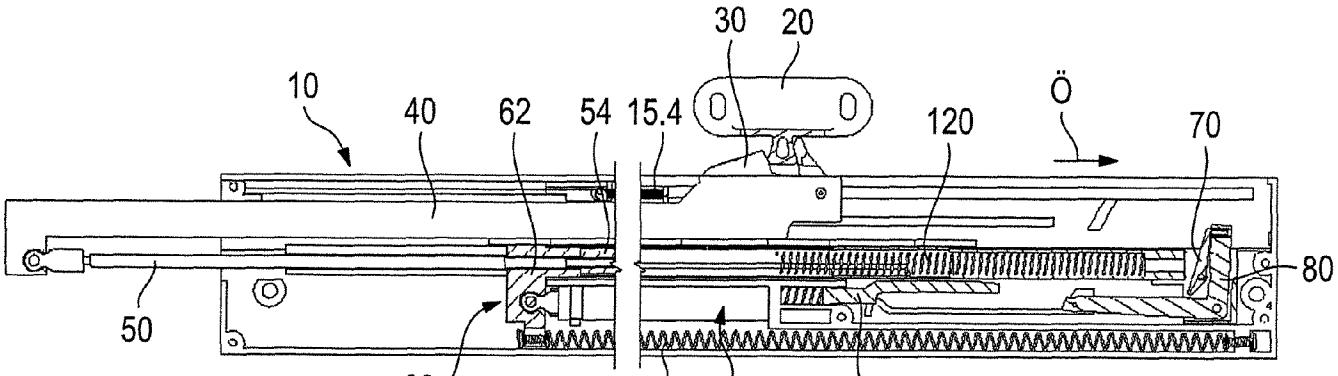
FIG. 6 shows a cross-sectional view of the sliding arrangement of FIG. 5 behind one of the covers.
Figure 7:
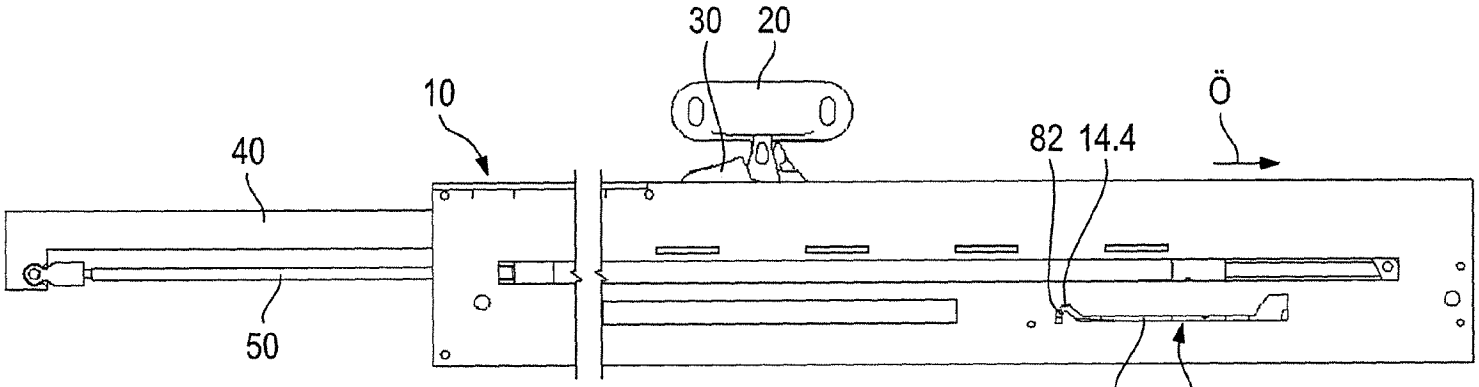
FIG. 7 shows a side view of the sliding arrangement of FIG. 1 as the drawer is located in a partially open position in which it can be gripped by hand and pulled open.
Figure 8:
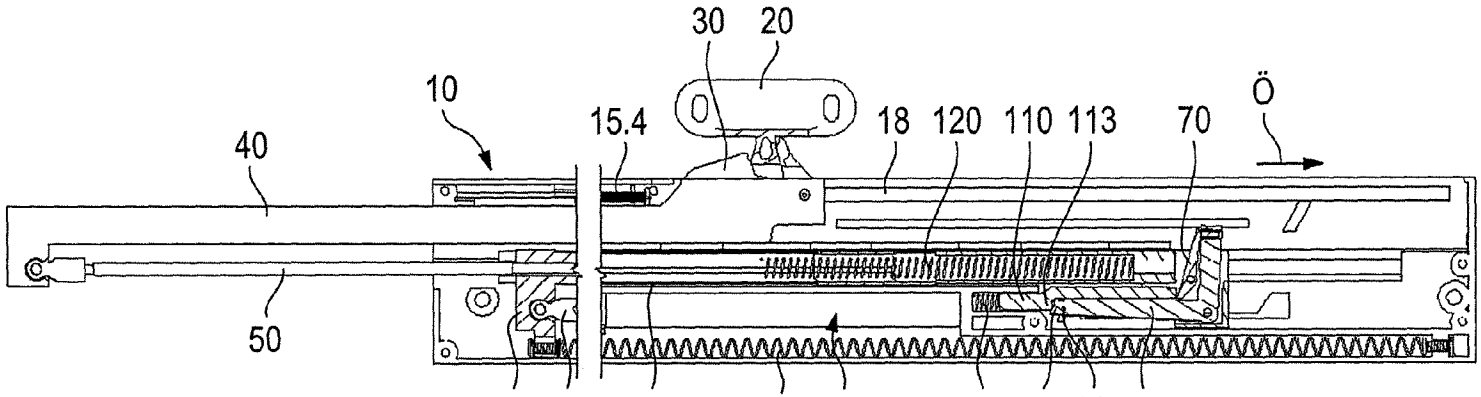
FIG. 8 shows a cross-sectional view of the sliding arrangement of FIG. 7 behind one of the covers.

With the adjustment of the housing 10 to the left, the switch 70 and the locking element 80 are also moved against a stop edge of the sliding piece 40. The switch 70 and the locking element 80 are thereby pivoted. The guiding element 82 is pivoted upward in the expansion 14.1 of the guide 14. The guiding element may also be referred to as a guide element 82. If the drawer is now balanced at the drawer front thereof, the spring 120 becomes effective as shown by the sequence of Figures according to FIGS. 5 and 6. Since the carrier 55 via the retention member 54, the coupling piece 50, the sliding piece 40 and the release piece 30 are coupled in a fixed manner to the activator 20, the spring 120 pushes the housing to the right in the opening direction Ö. This pushing-out movement controlled by the spring 120 is carried out in a forcibly guided manner on a part-path under the direct action of the spring 120. Afterwards, the sliding piece moves into a free-running action in which it is displaced as a result of the energy introduced by the spring 120 only as a result of the kinetic energy thereof. This displacement movement then stops when the retention member 54 strikes a stop of the retention member 62. The drawer is now located in a partially open position in which it can be gripped by hand and pulled open. This is shown in FIG. 7 and FIG. 8. The drawer can be moved further in the opening direction Ö. During this pulling-out movement, the release piece 30 remains coupled to the activator 20. Since the coupling piece 50 has stopped against the retention member 62, the coupling piece 50 pulls the pulling arrangement 60 as a result of the additional displacement of the housing 10 in the direction of the opening movement Ö. During this displacement, the piston rod 102 of the damper 100 is extended. At the same time, the spring 90 is tensioned. Since the pulling arrangement 60 is now coupled to the coupling piece 50, the housing 10 is also displaced relative to the pulling arrangement 60. This means that the locking element 80 is also adjusted in a relative manner with respect to the housing 10. The guiding element 82 is displaced in the guide 14 of the housing. It first slides along the linear guiding portion 14.2, then moves over the ramp portion 14.3, wherein it is pivoted in the bearing 83 and reaches the top dead center 14.4, as shown in FIG. 7. In this position, the release portion 85 of the locking element 80 strikes the switching piece 113 of the bar 110. In this instance, the locking element 80 pushes the bar 110 in the plane of the drawing according to FIG. 8 to the left counter to the pretensioning of the spring 112.

Figure 9:
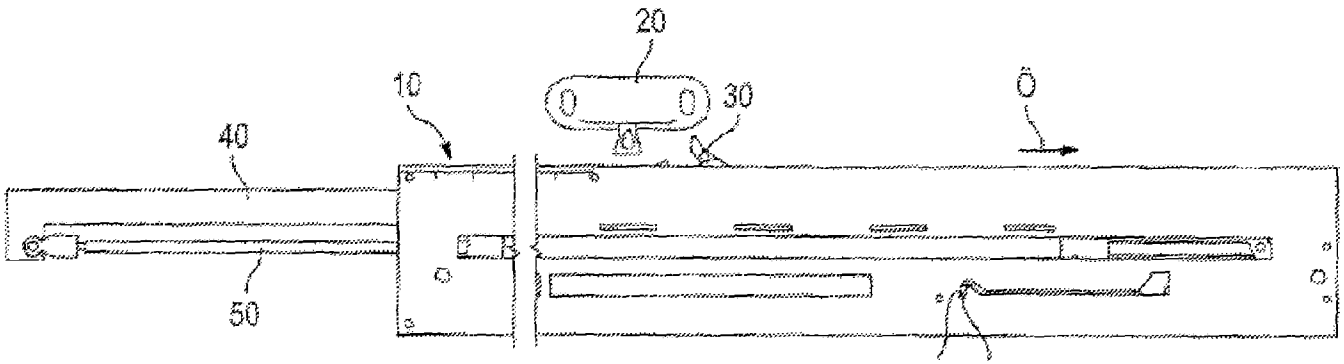
FIG. 9 shows a side view of the sliding arrangement of FIG. 1 as the drawer is pulled at least partially further open by a user.
Figure 10:
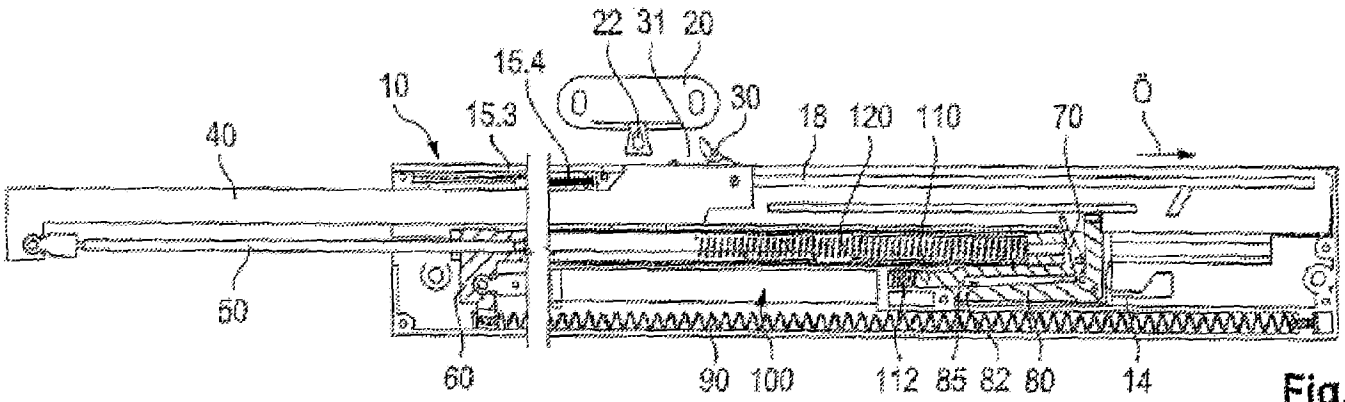
FIG. 10 shows a cross-sectional view of the sliding arrangement of FIG. 9 behind one of the covers.

During this adjustment movement, the release piece 30 is adjusted with the sliding piece 40, wherein the release piece 30 slides along in the guiding path 18 with the two guiding elements 34 and 35 thereof. If the drawer is now adjusted further in the opening direction, as shown in FIGS. 9 and 10, the housing 10 is also displaced further in the opening direction. The locking lever 80 slides with the guiding element 82 thereof further in the guide 14, wherein the guiding element 82 is moved into the region of the blocking portion 14.5. As shown in FIG. 10, the locking element 80 pivots downward in the counter-clockwise direction and the bar 110 is pushed as a result of the action of the spring 112 over the locking element and blocks it in the region of the release member 85.

The sliding piece 40 is adjusted with the release piece 30 further in the guiding path 18 until it reaches the tilted-away position thereof which is shown in FIG. 10. In this instance, as can be seen in FIG. 11, the guiding element 35 is received in the parking portion 18.2 and the release piece 30 has been tilted about the pivot axis formed by the guiding element 34. The release piece 30 releases the activator 20 and it blocks the sliding arrangement in the position shown in FIG. 10, wherein the damper 100 has been completely pulled out and the spring 90 has been completely tensioned. When the sliding piece 40 is displaced, the guiding piece 15.3 which is coupled to the sliding piece 40 via the spring 15.4 is moved to the left in the guide 15.1, wherein the spring 15.4 is then fully relaxed.

Figure 12:
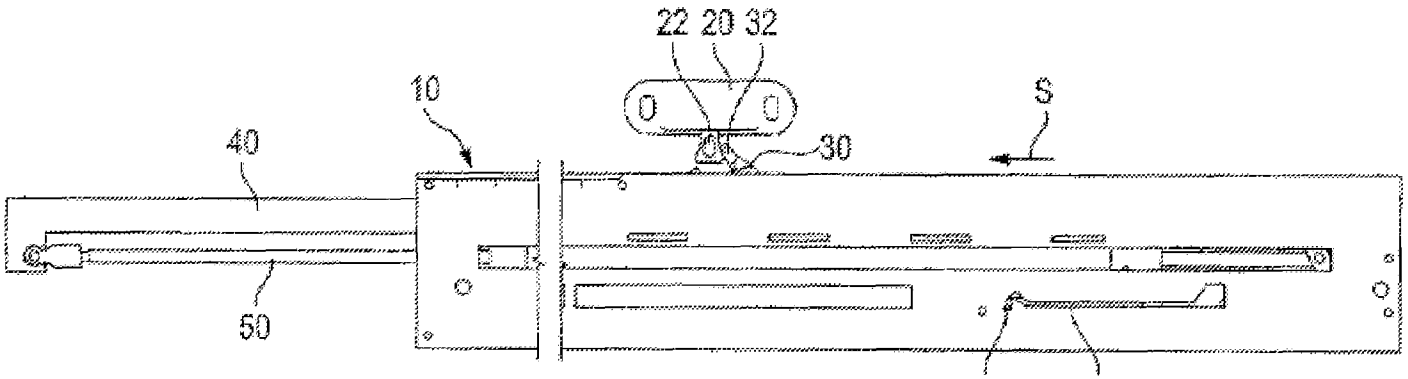
FIG. 12 shows a side view of the sliding arrangement of FIG. 1 as the drawer is pushed at least partially shut by a user.
Figure 13:
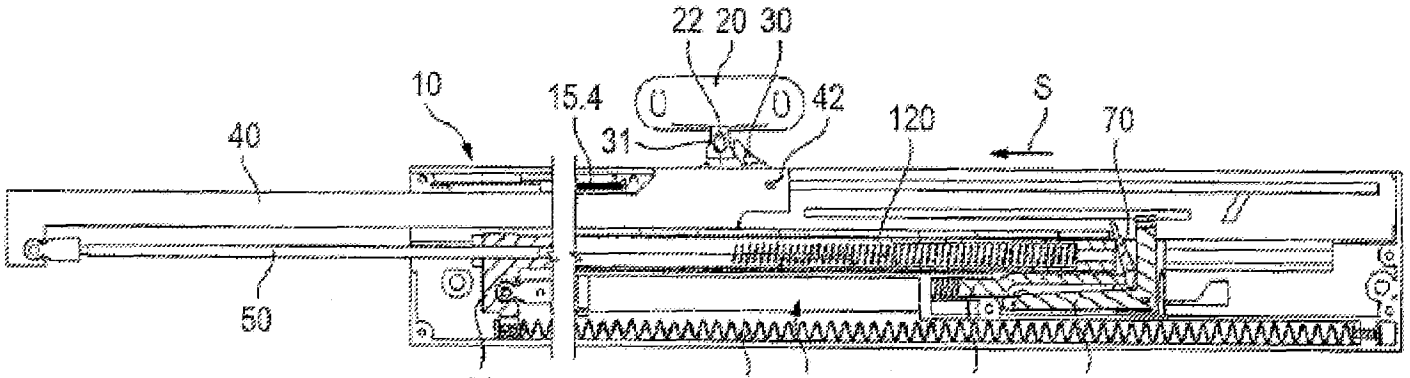
FIG. 13 shows a cross-sectional view of the sliding arrangement of FIG. 12 behind one of the covers.
Figure 14:
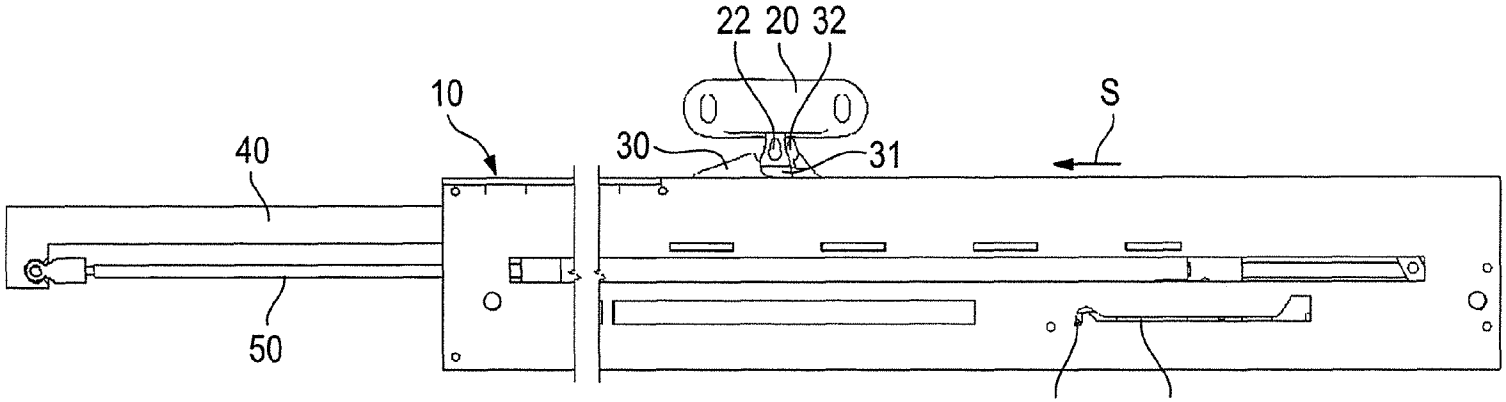
FIG. 14 shows a side view of the sliding arrangement of FIG. 1 as the drawer is moved farther shut and the release piece has moved to the securing position.
Figure 15:
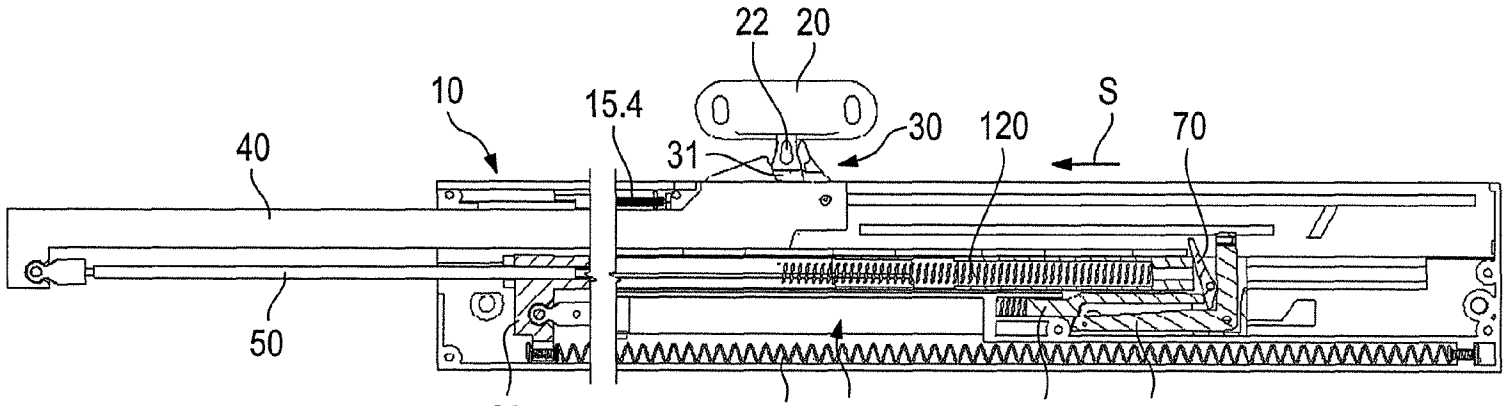
FIG. 15 shows a cross-sectional view of the sliding arrangement of FIG. 14 behind one of the covers.
Figure 16:
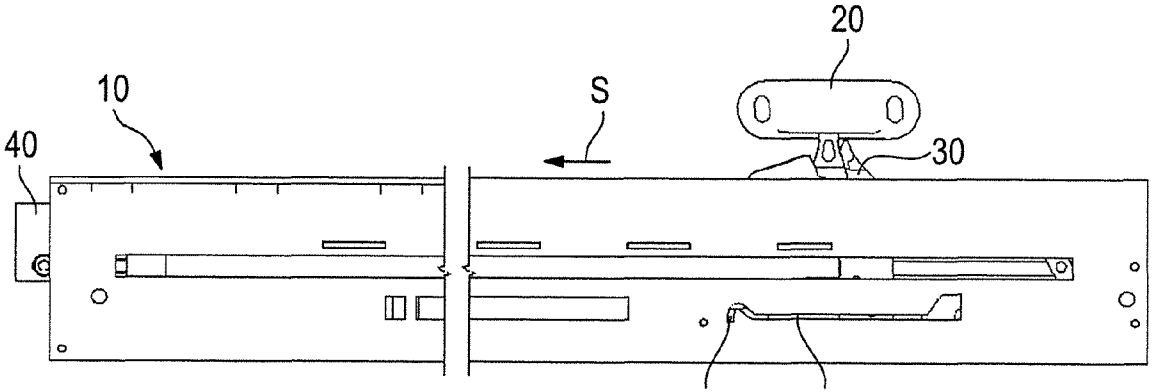
FIG. 16 shows a side view of the sliding arrangement of FIG. 1 as the drawer is moved farther shut.
Figure 17:
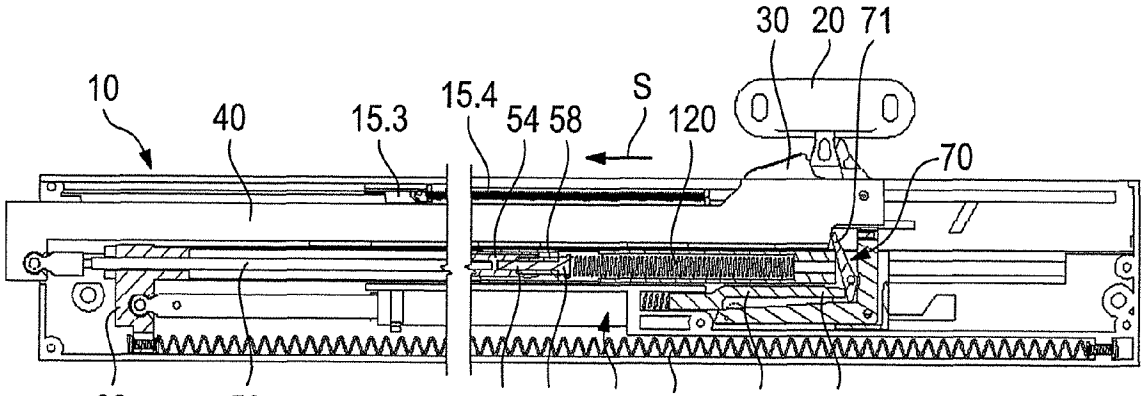
FIG. 17 shows a cross-sectional view of the sliding arrangement of FIG. 16 behind one of the covers.

The drawer can now be pulled completely and uninfluenced by the sliding arrangement into the opening position. FIGS. 12 and 13 now show the closure movement S of the drawer, wherein the drawer can first be adjusted in an uninfluenced manner, until the release piece 30 strikes the activator 20. In this instance, the carrier 22 strikes the stop 32. Since this impact location is eccentric with respect to the bearing 42, a tilting moment is applied and moves the release piece 30 from the pivoted position thereof shown in FIG. 12 into the securing position, in which it blocks the carrier 22 in the carrier receiving member 31, as shown in FIGS. 14 and 15. The release piece 30 is now guided with its two guiding elements 34, 35 in the region of the guiding portion 18.1 of the guiding path 18. Since the release piece 30 has therefore been moved out of the parking position thereof, the sliding piece 40 can again be adjusted relative to the housing 10. In this instance, the sliding piece 40 moves into the housing, whilst the housing 10 is moved further in the closure direction. The sliding path arrangement 60 continues to be blocked with respect to the housing 10 (locking element 80). As shown in FIGS. 16 and 17, the sliding piece 40 strikes with the catch ring 58 thereof the slotted guiding member of the pulling arrangement 60. At this location, the coupling piece 50 is then locked via the catch ring 58 to the pulling arrangement 60 in the slotted guiding member. Furthermore, the carrier 55 is moved with the support member 56 thereof counter to the spring 120 and it is tensioned as a result of the kinetic energy of the drawer. At the same time, the guiding piece 15.3 also moves against a stop of the guide 15.1 and the spring 15.4 is tensioned. FIGS. 16 and 17 finally show that the sliding piece 40 strikes the switch 70 only when the catch ring 58 has already been engaged in the slotted guiding member of the pulling arrangement 60.

Figure 18:
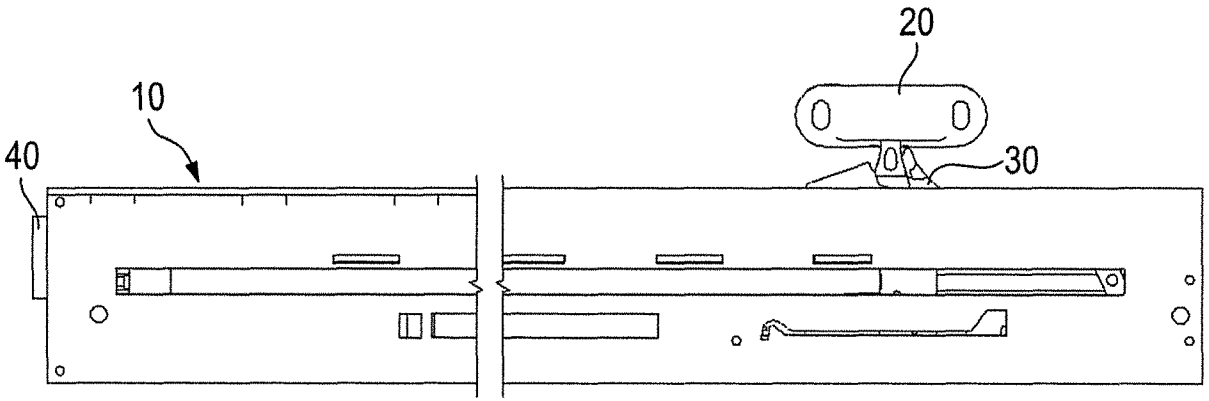
FIG. 18 shows a side view of the sliding arrangement of FIG. 1 as changes occur in the internal mechanisms due to the closing movement of the sliding arrangement just after FIG. 16.
Figure 19:
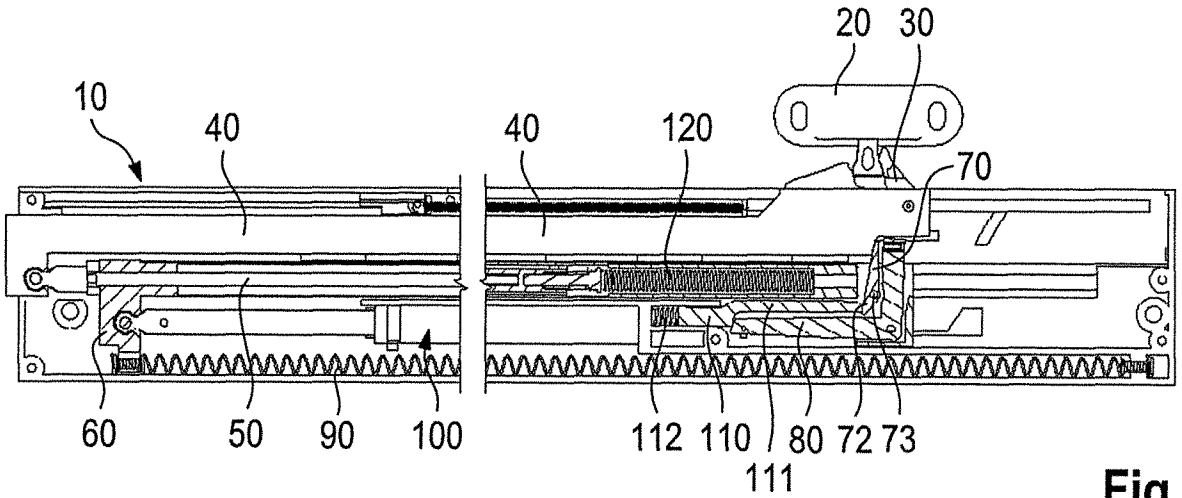
FIG. 19 shows a cross-sectional view of the sliding arrangement of FIG. 18 behind one of the covers.

As can be seen from FIGS. 18 and 19, the sliding piece 40 now moves the switch 70 and rotates it about the bearing 73 in the clockwise direction. The lever arm 72 is thereby pressed against the actuation piece 111 of the bar 110. The bar 110 is consequently adjusted counter to the pretensioning of the spring 112, until it releases the locking element 80.

Figure 20:
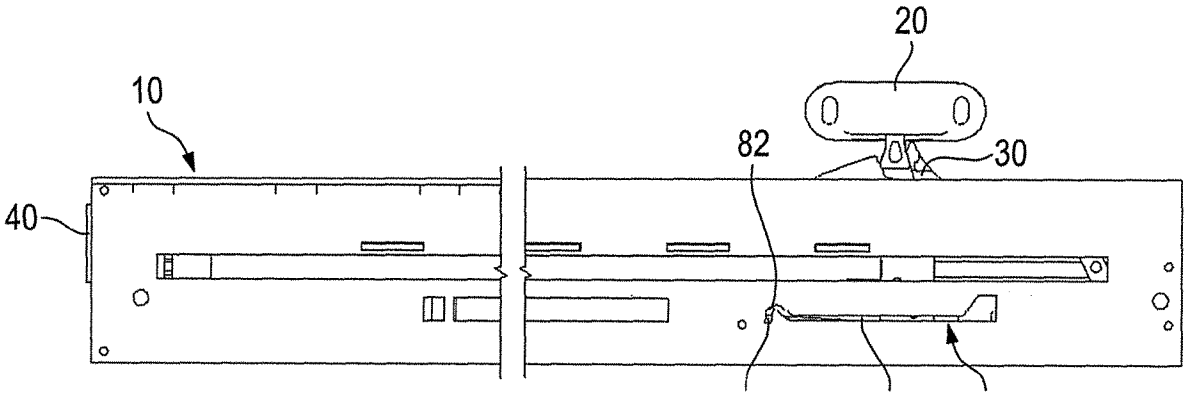
FIG. 20 shows a side view of the sliding arrangement of FIG. 1 as the drawer closes farther due to at least one spring counter to at least one damper.
Figure 21:
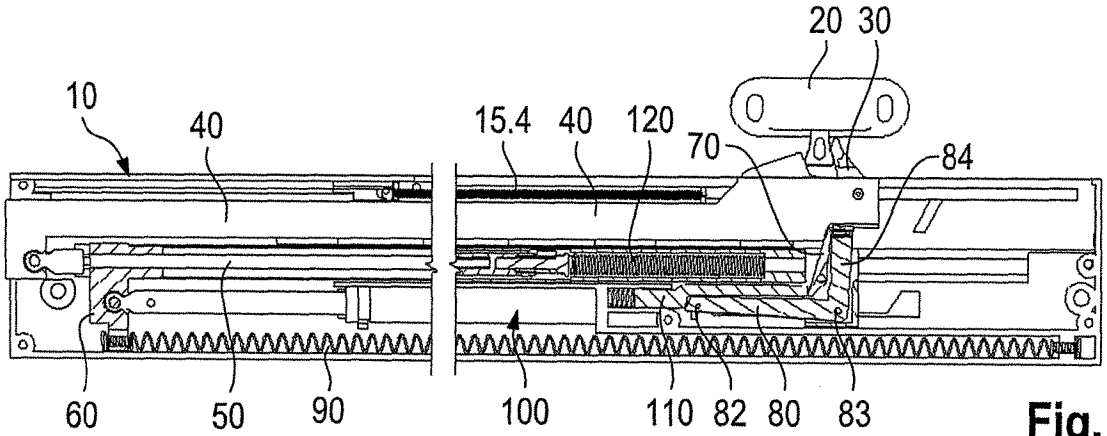
FIG. 21 shows a cross-sectional view of the sliding arrangement of FIG. 20 behind one of the covers.
Figure 22:
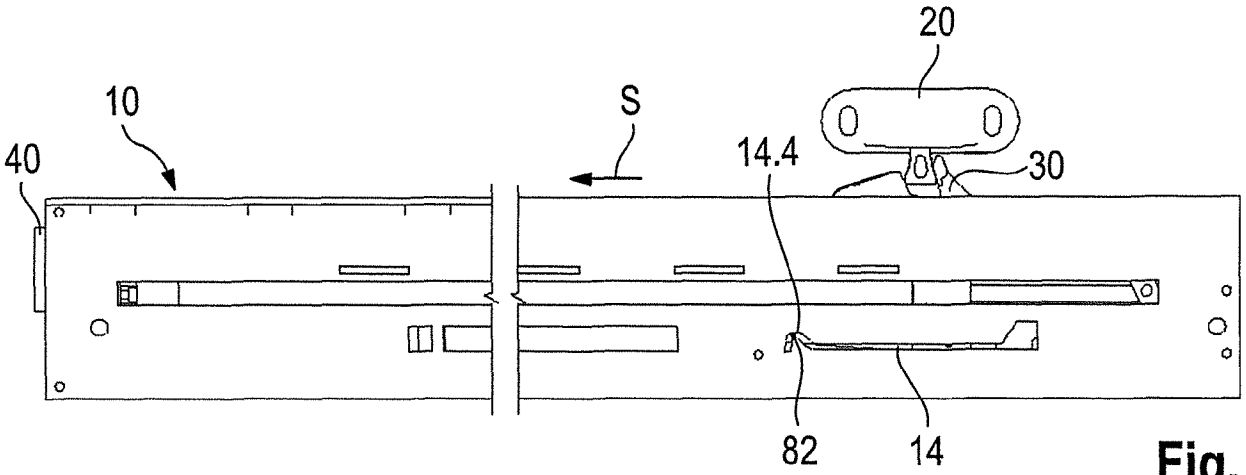
FIG. 22 shows a side view of the sliding arrangement of FIG. 1 as the drawer closes even farther from the position shown in FIG. 20.
Figure 23:
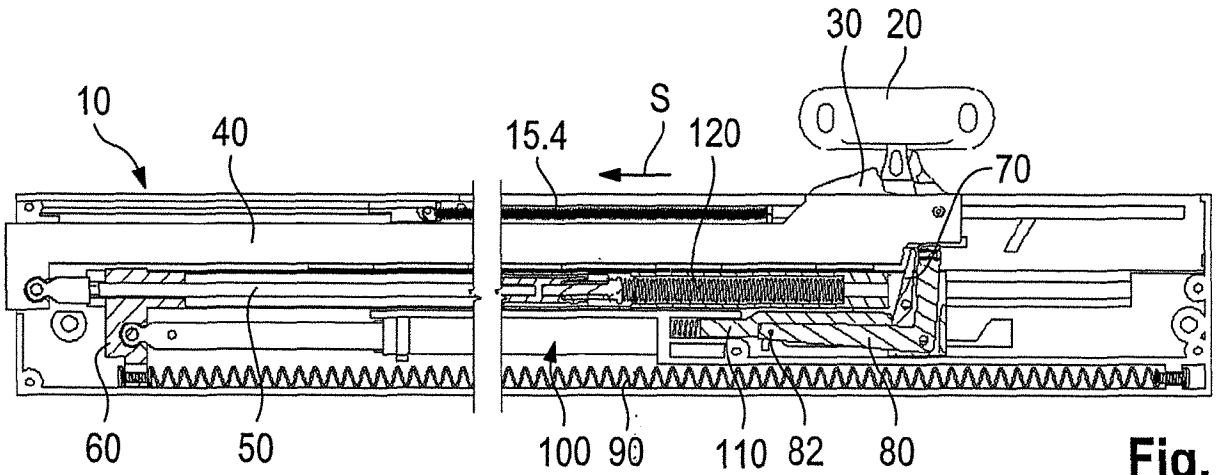
FIG. 23 shows a cross-sectional view of the sliding arrangement of FIG. 22 behind one of the covers.

As shown in FIGS. 20 and 21, the sliding piece 40 now presses via the switch against the switch attachment 84 of the locking element 80. The locking element 80 is thereby pivoted in the clockwise direction about the bearing 83. The guiding element 82 thereby moves out of engagement with the blocking portion 14.5 and is guided as far as the top dead center 14.4. In this position, the pulling arrangement 60 is released. The spring 90 is now effective and pulls the pulling arrangement 60 counter to the damping force of the damper 100. Since the pulling arrangement is coupled to the sliding piece 40 via the coupling piece 50 and the release piece 30 is retained on the activator, the drawer is retracted in a forcibly guided manner and at the same time damped. As shown in FIG. 23, as a result of this retraction movement, the switch 70 is again moved a short distance away from the sliding piece 40.

Figure 24:
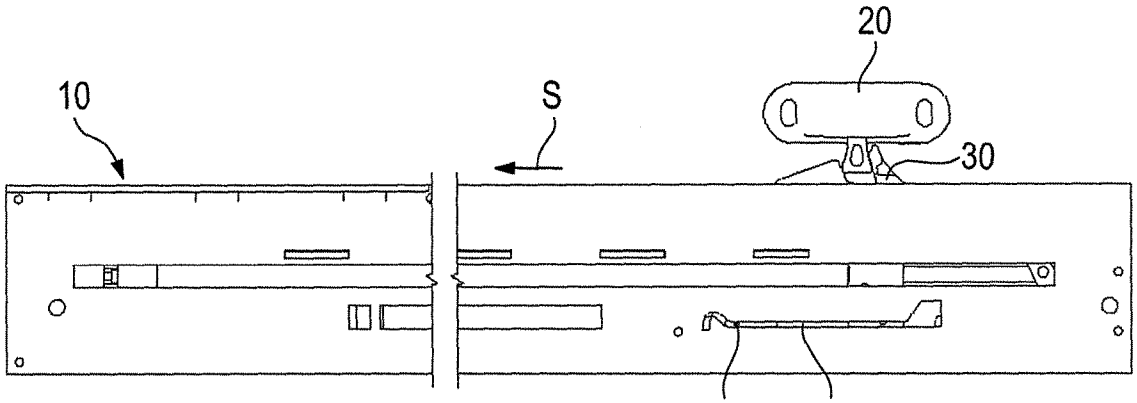
FIG. 24 shows a side view of the sliding arrangement of FIG. 1 as the drawer closes farther still from the position shown in FIG. 22.
Figure 25:
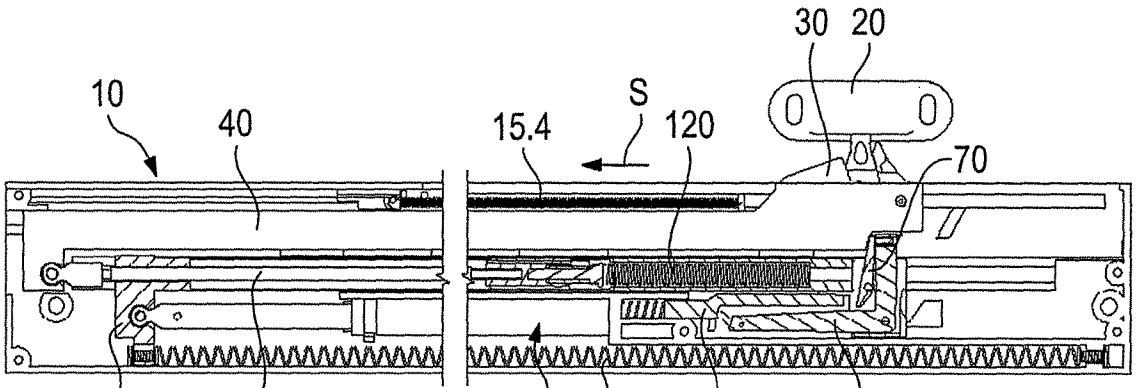
FIG. 25 shows a cross-sectional view of the sliding arrangement of FIG. 24 behind one of the covers.
Figure 26:
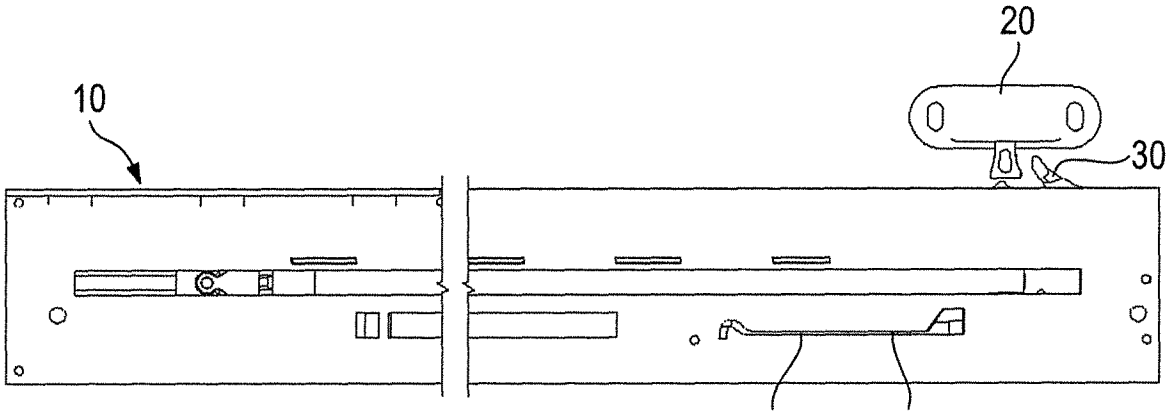
FIG. 26 shows the sliding arrangement of FIG. 1 with the release piece in the folded-away position due to an opening force when the sliding arrangement does not move correctly due to, for instance, a defect in the sliding arrangement.

FIGS. 24 and 25 now show the additional path of the retraction movement in the closure direction S, wherein the guiding element 82 is now moved in the guiding portion 14.2. During this retraction movement, the spring 15.4 which is significantly weaker than the resilient force of the spring 90 and which is constructed as a draw spring is further tensioned.

The closure movement in the closure direction S is now continued until the initial position shown in FIG. 1 is reached.

In this position, the spring 15.4 is fully tensioned, the spring 120 is also tensioned and the spring 90 is relaxed, wherein a degree of residual tension is maintained in this instance on the spring 90 in order to ensure play-free tensioning.

Figure 28:
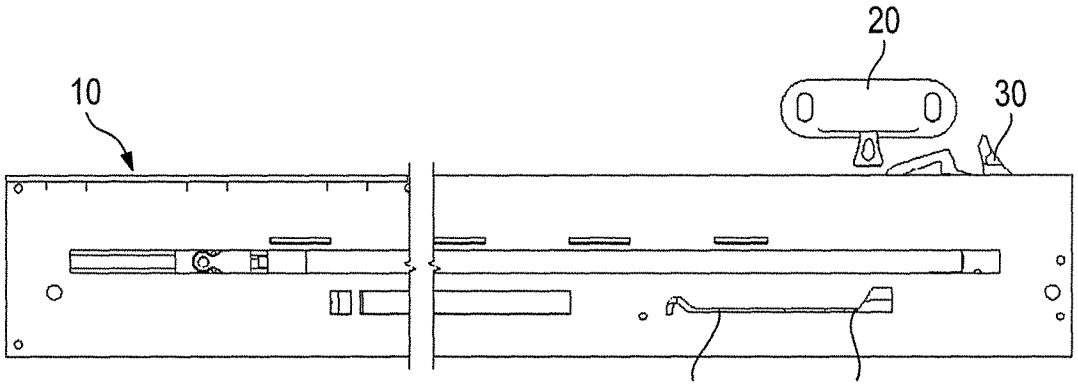
FIG. 28 shows the sliding arrangement of FIG. 1 opened farther from the position in FIG. 26.
Figure 29:
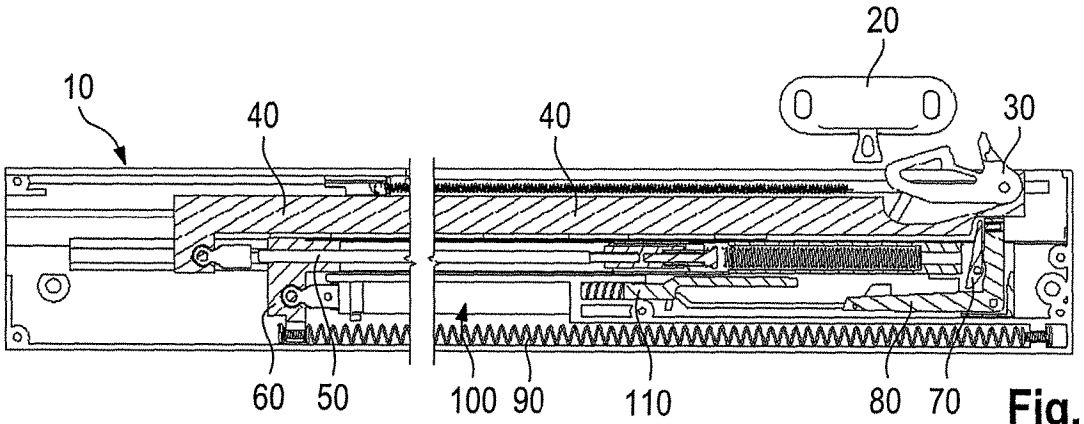
FIG. 29 shows a cross-sectional view of the sliding arrangement of FIG. 28 behind one of the covers.
Figure 30:
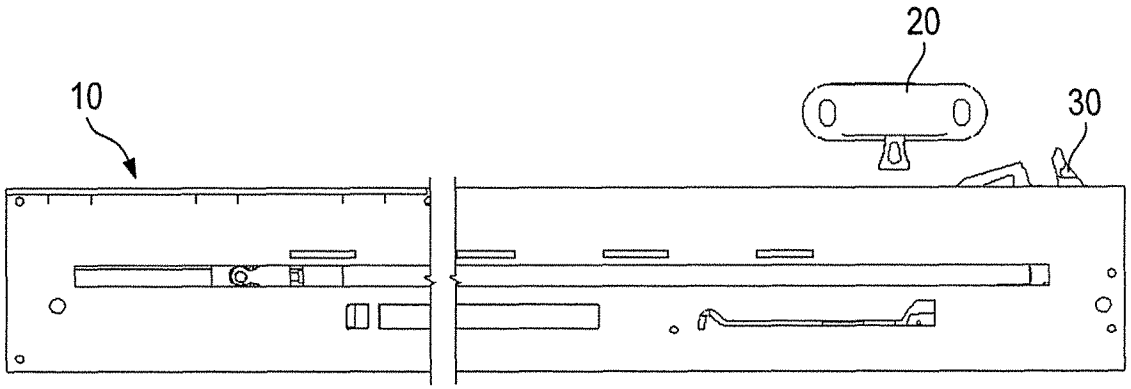
FIG. 30 shows the sliding arrangement of FIG. 1 opened farther still from the position in FIG. 28.
Figure 31:
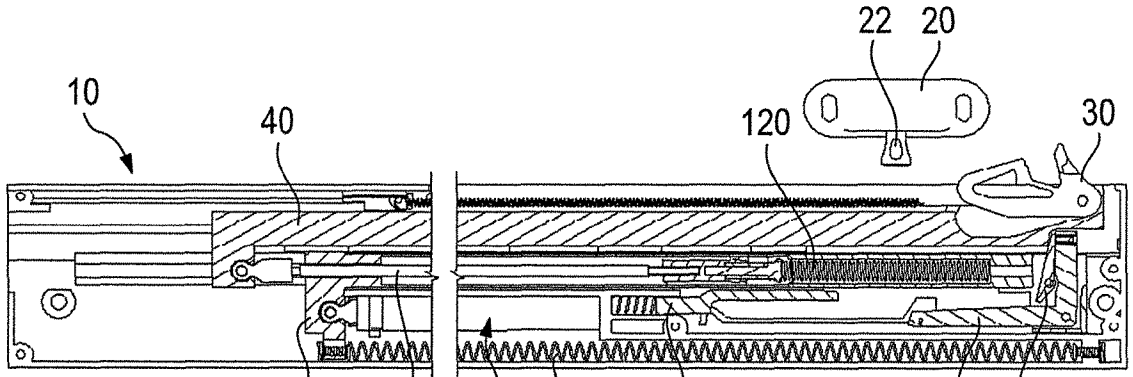
FIG. 31 shows a cross-sectional view of the sliding arrangement of FIG. 30 behind one of the covers.

In the sequence of Figures according to FIGS. 26 to 31, it is shown how the drawer can be opened if, for example, as a result of a defect of the sliding arrangement, it can no longer be moved correctly. The activator 20 then strikes the stop 33 of the release piece 30 with a carrier 22. When the drawer is pulled as a result of the spacing of the stop 33 from the guiding element 34 (which brings about the pivotable support), a torque is thereby introduced into the release piece 30. This torque which rotates to the right according to FIG. 27 results in the release piece being folded away. In this instance, the guiding element 35 (see FIG. 11) is introduced into the region of the parking portion 18.3. The activator 20 is thereby released and the drawer can be pulled out in an unimpeded manner. As shown in FIGS. 28 and 29, after the activator has left the release piece 30, it can tilt back into the initial position thereof and the sliding piece 40 which has been moved slightly to the left can again be pulled back by the spring 90. FIGS. 30 and 31 again show the fully retracted sliding piece with the raised release piece and the released activator. If the drawer is now closed again, the carrier 22 of the activator 20 strikes the spring portion 33.1 and bends it away, wherein the connection 33.2 yields in a resilient manner and a pivoting of the resilient portion takes place substantially in the articulation region 36. The carrier 22 can then move into the carrier receiving member 31 and the drawer is secured in the closure position thereof again.

As described above, the sliding piece 40 starting from the position according to FIG. 4 is accelerated by means of both springs 15.4 and 120 after selection of the excess travel. In this instance, the spring 120 presses on the coupling piece and the spring 15.4 pulls the sliding piece 40 directly. To this end, as mentioned above, the spring 15.4 is connected to the sliding piece at one end thereof. The other end of the spring 15.4 is secured to the guiding piece 15.3. The guiding piece 15.3 is fixedly blocked on the housing 10 in the position shown in FIG. 4. When the two springs 120 and 15.4 are relaxed, the spring 120 is first discharged. Subsequently, after the spring 120 has been completely discharged, the spring 15.4 continues to act on the sliding piece and moves it under the action of resilient force. The spring control is therefore selected in such a manner that both springs 120, 15.4 initially act on the sliding piece 40. After the spring 120 has been discharged, only the spring 15.4 acts until the sliding piece has reached the position shown in FIG. 6. Then, both springs 120 and 15.4 are discharged.

The charging of the two springs is carried out in the opposite direction, as shown in the image sequence according to FIGS. 14 to 19. First, when the sliding piece 40 is introduced, the spring 15.4 is tensioned, then the coupling piece 50 strikes the spring 120 and tensions it. In this operating state, both springs 15.4 and 120 are then charged by the sliding piece 40 as soon as the coupling piece 50 has engaged with the catch ring 58 thereof in the slotted switching member of the pulling arrangement 60, the spring 120 and also the spring 15.4 is completely tensioned.

The two springs 15.4 and 120 bring about a long resiliently controlled pushing-out path, wherein at the beginning both springs 15.4 and 120 act at the same time on the sliding piece in order to bring about a significant pushing-out force. After the drawer has been moved and the spring 120 has been discharged, the low resilient tension of the spring 15.4 is sufficient to maintain the movement of the drawer. It is consequently possible to produce a large displacement path of the drawer. Since the spring 15.4 has a low spring constant, it can be charged again with little energy so that the drawer is not noticeably prevented from being pushed closed.

Of course, the pushing arrangement shown in the drawings can also be carried out simply with the spring 120. The spring 15.4 is only optional and, as described above, serves to produce a larger pushing-out movement with improved operating comfort.

The invention claimed is:

1. A slide-out assembly comprising:
a slide piece;
a pull assembly configured to be resiliently pretensioned in a parking position;
a coupler connected to the slide piece and the pull assembly;
a lock element configured to block the pull assembly in the parking position, the lock element including:
a retention member; and
a guide element disposed on the retention member, the guide element configured to adjust according to a guide recess when the lock element is displaced with the pull assembly; and
a bar configured to lock the lock element in the parking position.

2. A slide-out assembly comprising:
a slide piece;
a pull assembly configured to be resiliently pretensioned in a parking position;
a coupler connected to the slide piece and the pull assembly;
a lock element configured to block the pull assembly in the parking position, the lock element including a lock switch member;
a bar configured to lock the lock element in the parking position; and
wherein the slide piece is configured to actuate the lock switch member.

3. The slide-out assembly of claim 2, further comprising a bar spring configured to resist an actuation of the bar.

4. The slide-out assembly of claim 2, wherein:
the bar includes a bar switch portion; and
the lock element includes a lock release portion configured to cooperate with the bar switch portion to move the bar from the parking position.

5. The slide-out assembly of claim 2, wherein:
the pull assembly includes a lock bearing, the lock element pivotably supported on the lock bearing; and
the lock element further includes a retention member, the retention member and the lock switch member forming lever arms of the lock element.

6. The slide-out assembly of claim 2, further comprising:
a release piece configured to move between a release position and a locked position; and
wherein the slide piece includes a release end and a coupler end opposite the release end, the release end connected to the release piece and the coupler end connected to the coupler.

7. The slide-out assembly of claim 2, further comprising at least two springs configured to act on the slide piece and move the slide piece to a slide out position.

8. The slide-out assembly of claim 7, wherein the springs are positioned in parallel to each other.

9. The slide-out assembly of claim 7, wherein the at least two springs includes a pressure spring and a draw spring.

10. A slide-out assembly comprising:
a slide piece;
a pull assembly configured to be resiliently pretensioned in a parking position;
a coupler connected to the slide piece and the pull assembly;
a lock element configured to block the pull assembly in the parking position;
a bar configured to lock the lock element in the parking position, the bar including an actuation piece;
an actuation switch configured to act on the actuation piece and actuate the bar when the lock element is blocked; and
wherein the pull assembly includes an actuation switch bearing, the actuation switch pivotably supported on the actuation switch bearing.

11. The slide-out assembly of claim 10, wherein the slide piece is configured to switch the actuation switch.

12. The slide-out assembly of claim 10, wherein the actuation switch includes a switch lever with a first switch lever arm configured to move into operational connection with the slide piece and a second switch lever arm configured to move into operational connection with the bar.

* * * * *